US005102620A

United States Patent [19]

Watson et al.

[11] Patent Number: 5,102,620

[45] Date of Patent: Apr. 7, 1992

[54] COPPER ALLOYS WITH DISPERSED METAL NITRIDES AND METHOD OF MANUFACTURE

[75] Inventors: William G. Watson, Cheshire; Sankaranarayanan Ashok, Bethany; Harvey P. Cheskis, North Haven, all of Conn.

[73] Assignee: Olin Corporation, New Haven, Conn.

[21] Appl. No.: 531,601

[22] Filed: Jun. 1, 1990

Related U.S. Application Data

[62] Division of Ser. No. 332,182, Apr. 3, 1989, Pat. No. 4,961,457.

[51] Int. Cl.[5] ..... C22C 9/00; B22D 23/00

[52] U.S. Cl. ..... 420/469; 164/46; 164/463; 420/471; 420/472; 420/473; 420/476

[58] Field of Search ..... 420/471, 472, 473, 476, 420/478, 484, 469; 164/46, 461, 475, 463

[56] References Cited

U.S. PATENT DOCUMENTS

| | | | |
|---|---|---|---|
| Re. 31,767 | 10/1975 | Brooks | 29/527.2 |
| 3,696,502 | 10/1972 | Darling | 164/46 |
| 3,775,156 | 11/1973 | Singer | 427/177 |
| 3,826,301 | 7/1974 | Brooks | 164/46 |
| 3,899,820 | 8/1975 | Read et al. | 419/23 |
| 4,047,933 | 9/1977 | Larson et al. | 75/255 |
| 4,066,117 | 1/1978 | Clark et al. | 164/46 |
| 4,540,546 | 9/1985 | Giessen | 164/463 |
| 4,559,200 | 12/1985 | Yamasaki et al. | 420/473 |
| 4,804,034 | 2/1989 | Leatham et al. | 164/46 |
| 4,901,784 | 2/1990 | Ashok et al. | 164/429 |
| 4,907,639 | 3/1990 | Ashok et al. | 164/46 |
| 4,917,170 | 4/1990 | Sankaranarayanan et al. | 164/429 |
| 4,925,103 | 5/1990 | Muench | 239/79 |
| 4,926,927 | 5/1990 | Watson et al. | 164/429 |

FOREIGN PATENT DOCUMENTS

| | | | |
|---|---|---|---|
| 55-34666 | 3/1980 | Japan | 420/472 |
| 62-275561 | 11/1987 | Japan . | |
| 64-18560 | 1/1989 | Japan . | |
| PCT/GB88/-01106 | 6/1989 | PCT Int'l Appl. . | |
| 217290 | 10/1986 | United Kingdom . | |

OTHER PUBLICATIONS

Evoluation of Microstructure in Spray Cast Cu-Zr. By Rishi Pal Singh and Alan Lawley. Department of Materials Engineering, Drexel Unversity, Philadelphia, Pa. 19104. pp. 489-502.

Ospray Metals Limited. The Ospray Preform Process (date uncertain).

Modern Developments in Powder Metallurgy By Leatham "The Ospray Process for the Production of Spray-Deposited Roll, Disc, Tube and Billet Preforms" appearing in *Modern Developments In Powder Metallurgy*, vol. 15-17, 1985 (pp. 157-173).

"The Ospray Preform Process" Evans et al., appearing in Powder Metallurgy, 1985.

*Primary Examiner*—Richard O. Dean
*Assistant Examiner*—Robert R. Koehler
*Attorney, Agent, or Firm*—Gregory S. Rosenblatt; Paul Weinstein

[57] ABSTRACT

Spray cast alloys having reduced porosity and increased ductility are provided as well as a process for the manufacture of the alloys. An effective amount of a reactive metal which reacts with the spray casting atmosphere but not with the desired alloy is dissolved into the alloy prior to spray casting. Preferred reactive metals readily form a nitride which is finely dispersed throughout the spray cast alloy.

10 Claims, 3 Drawing Sheets

COPPER ALLOYS WITH DISPERSED METAL NITRIDES AND METHOD OF MANUFACTURE

This application is a division of application Ser. No. 07/332,182, filed Apr. 3, 1989 now U.S. Pat. No. 4,961,457.

This invention relates to metal alloys produced by spray casting. More particularly, the invention relates to a method for reducing the porosity of spray cast articles by the addition of a reactive element to the alloy prior to spray casting.

Spray casting is a method to manufacture metal or metal alloy articles directly to a desired shape. The basic spray casting process comprises the steps of:

1. Atomizing a fine stream of molten metal.

2. Rapidly cooling the particles in flight so that the particles are either at or near the solidification temperature.

3. Depositing the particles on a collector. The collector is sometimes chilled to promote rapid solidification upon impact. Further, the collector moves in a predetermined pattern to generate a metal preform having a desired shape.

4. Optionally, working or directly machining the preform to generate the final shape and/or properties required.

This spray casting process is generally known as the OSPREY PROCESS and is more fully disclosed in U.S. Pat. Nos. RE 31,767 and 4,804,034 as well as United Kingdom Patent No. 2,172,900 A all assigned to Osprey Metals Limited of Neath, Wales. Further details about the process may be obtained from a publication entitled "The Osprey Preform Process" by Osprey Metals Ltd.

Spray cast products have many desirable properties. The articles are categorized by a fine microstructure, no macro-segregation and enhanced mechanical properties.

However, the density of the spray cast product is often low. To optimize the physical and electrical properties, densities approaching 100% of the theoretical density of the alloy are desirable. The porosity of spray cast products may range to as high as 15% to 20% and densities of from about 90% to about 95% of theoretical are generally considered acceptable. Densities of about 98% theoretical and above are desirable but until now difficult to obtain.

Several schemes for improving the density of spray cast articles have been disclosed. U.S. Pat. No. Re. 31,767 discloses subjecting the article to a subsequent densification process such as drop forging. U.S. Pat. No. 3,775,156 discloses passing a spray cast strip through a rolling mill to reduce porosity.

A process for improving the density of spray cast articles by increasing kinetic energy and supercooling the atomized droplets is disclosed in U.S. Pat. No. 4,066,177. The patent discloses the use of extremely cold (−168° C. to −193° C.) gas accelerated to supersonic speeds to impinge the molten stream to cause atomization.

A well known process somewhat related to spray casting is powder metallurgy. Unlike spray casting in which the preform article is formed directly by the impact of the atomized droplets on the collector plate, in powder metallurgy, a molten stream of metal is atomized. The atomized droplets are allowed to solidify. The solidified powder is collected and subsequently compacted into a desired shape by a combination of heat and pressure to enact sintering of the individual powder particles.

U.S. Pat. No. 4,047,933 discloses a process to reduce the porosity of metal powders by the addition of an activating agent to the metal alloy. The activating agent is selected to have an affinity for oxygen. An inert gas is used for atomization and the necessary oxygen is present as residual contamination. An oxide skin is formed on the surface of the particles.

This process is not analogous to spray casting. In powder metallurgy, the particles are solidified in an essentially spherical shape and oxide skin remains on the surface of the individual spheres. In spray casting as described hereinbelow, the skin is ruptured upon impact with the collector surface resulting in large flattened particles, typically referred to as "splats". The surface skin is usually ruptured resulting in the alloy containing a fine dispersion of skin particles.

Therefore, in accordance with the invention, the inventors have developed a method for the manufacture of shaped articles by spray casting in which the articles are characterized by lower porosity and higher density than achieved by conventional spray casting. It is a feature of the invention that this improvement in density is achieved without the need for subsequent mechanical working. It is a further feature of the invention that modifications to the standard spray casting apparatus is not required to achieve these benefits.

It is an advantage of the invention that the method produces shaped articles having reduced grain size and improved ductility. It is a further advantage of the invention that the method produces shaped articles having improved physical and electrical properties.

Accordingly, there is provided a process for substantially reducing the porosity of a spray cast article. The process comprises the steps of melting an alloy having a desired composition and dissolving an effective amount of a reactive element into the molten alloy. A molten stream containing the alloy with the dissolved reactive element is atomized. The reactive element reacts with the atomizing gas to form a nitride surface film. The droplets are collected on a collecting surface and rapidly solidify to form a shaped article having increased density and improved physical and electrical properties.

Figure 1:
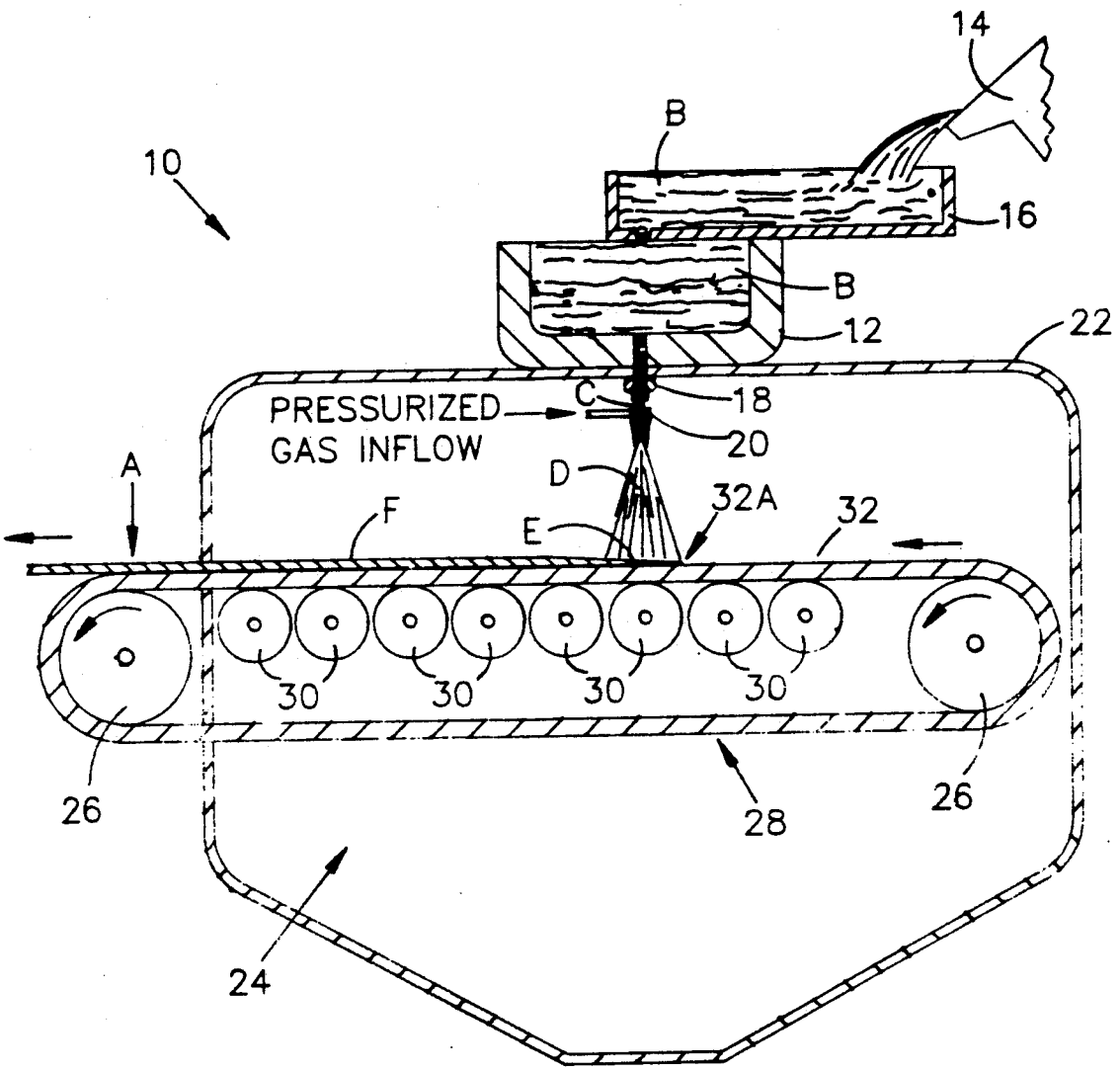
FIG. 1 illustrates a spray casting apparatus for the manufacture of a metal strip as employed for a method of the invention.

FIG. 1 illustrates a spray deposition apparatus 10 as known in the art. The system as illustrated produces a continuous strip of product A. The manufacture of discrete articles is also obtainable by changing the collecting surface as claimed in a second embodiment of the invention.

The spray deposition apparatus 10 employs a tundish 12 in which a metal alloy having a desired composition B is held in molten form. The tundish 12 receives the molten alloy B from a tiltable melt furnace 14, via a transfer launder 16. The tundish 12 further has a bottom nozzle 18 through which the molten alloy B issues in a continuous stream C. A gas atomizer 20 is positioned below the tundish bottom nozzle 18 within a spray chamber 22 of the apparatus 10.

The atomizer 20 is supplied with a gas under pressure from any suitable source. The gas serves to atomize the molten metal alloy and also supplies a protective atmosphere to prevent oxidation of the atomized droplets. The gas should preferably not react with the molten alloy. A most preferred gas is nitrogen. The gas should have a low concentration of oxygen to avoid the formation of undesirable oxides. An oxygen concentration of less than 100 ppm and preferably less than about 10 ppm is desired. The atomizer 20 surrounds the molten metal stream C and impinges the gas on the stream C so as to convert the stream into a spray D comprising a plurality of atomized molten droplets. The droplets are broadcast downward from the atomizer 20 in the form of a divergent conical pattern. If desired, more than one atomizer 20 may be used. The atomizer(s) 20 may be moved in a desired pattern for a more uniform distribution of the molten metal particles.

A continuous substrate system 24 as employed by the apparatus 10 extends into the spray chamber 22 in generally horizontal fashion and in spaced relation to the gas atomizer 20. The substrate system 24 includes a drive means comprising a pair of spaced rolls 26, an endless substrate 28 in the form of a flexible belt entrained about and extending between the spaced rolls 26 and a series of rollers 30 which underlie and support an upper run 32 of the endless substrate 28. An area 32A of the substrate upper run 32 directly underlies the divergent pattern of spray D. The area 32A receives a deposit E of the atomized metal particles to form the metal strip product A.

Figure 2:
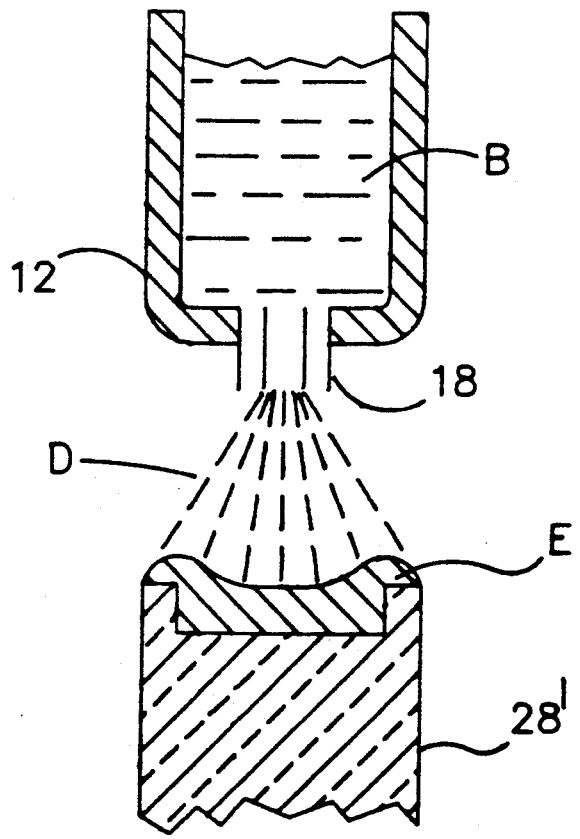
FIG. 2 illustrates a spray casting apparatus for the manufacture of a discrete metal article as employed for a method of the invention.

For certain applications, it may be desirable to form the alloy into a discrete article rather than a continuous strip. For these applications, the continuous substrate 28 is replaced with a collecting mold 28' as shown in FIG. 2. The system illustrated in FIG. 2 has been simplified by the removal of elements not required to differentiate FIG. 1. Elements performing similar functions to the elements of FIG. 1 have been designated with like reference numerals. The support elements of FIG. 1, such as furnace and spray chamber while not shown in FIG. 2 may be included in this embodiment and all other embodiments as well.

A divergent cone D of precursor droplets strikes the collecting mold 28'. The mold is shaped to form a desired article as disclosed in the above-cited U.S. Pat. No. Re. 31,767 which is incorporated herein by reference. Any desired shaped article may be formed by the selection of a properly shaped mold.

Referring back to FIG. 1, the atomizing gas flowing from the atomizer 20 is much cooler than the molten metal B in the stream C. Thus, the impingement of atomizing gas on the spray particles during flight and the subsequent deposition on the substrate 28 extracts heat from the particles. The metal deposit E is cooled to below the solidus temperature of the alloy B forming a solid strip F which is carried from the spray chamber 22 by the substrate 28.

Figure 3:
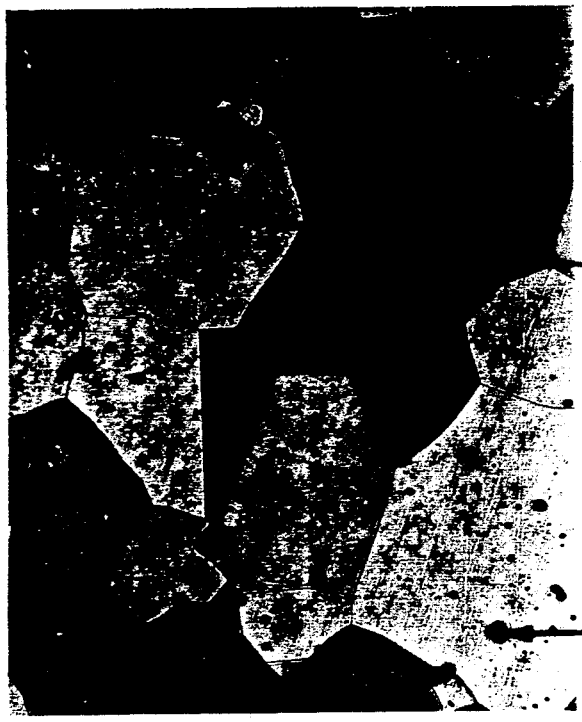
FIG-3 PRIOR ART
FIG. 3 is a photograph of a cross section of a metallic article formed by conventional spray casting techniques magnified 100 times.

FIG. 3 is a photograph of a cross section of a portion of a copper alloy strip as viewed through a microscope after etching. The porosity and grain structure may be enhanced by any suitable etching solution. The solution commonly known as ASM #4 has been found to be particularly useful. This etchant comprises a stock solution consisting of 40 grams chromium trioxide, 7.5 grams ammonium chloride, 50 ml nitric acid, 50 ml sulfuric acid and 850 ml deionized water. The stock solution is diluted 4:1 with water (4 parts water: 1 part stock), applied to a polished sample and rinsed off after about 10 seconds.

The strip shown in FIG. 3 was produced by conventional spray casting as detailed hereinabove. The magnification is 100 times.

A copper alloy having a nominal composition of 97.6% by weight copper, 2.35% by weight iron, and 0.05% by weight phosphorous was processed both by conventional spray casting and the process of the invention. The alloy is characterized by high electrical conductivity (approximately 60% IACS) and a high yield strength. Alloys of this type are favored for the manufacture of leadframes for electronic packaging applications.

FIG. 3 illustrates two properties of the conventionally spray cast copper alloy which are improved by the process of the invention. The grains 34 which make up the alloy are large. It is desirable to minimize grain size and to maximize the ductility of the alloy. The conventionally cast alloy is also porous. Pores 36 are dispersed throughout the alloy both at grain boundaries and intragranualarly. The pores 36 are undesirable because they reduce the strength of the overall alloy, reduce electrical conductivity by serving as high resistance points and serve as points to initiate fracture.

Figure 4:
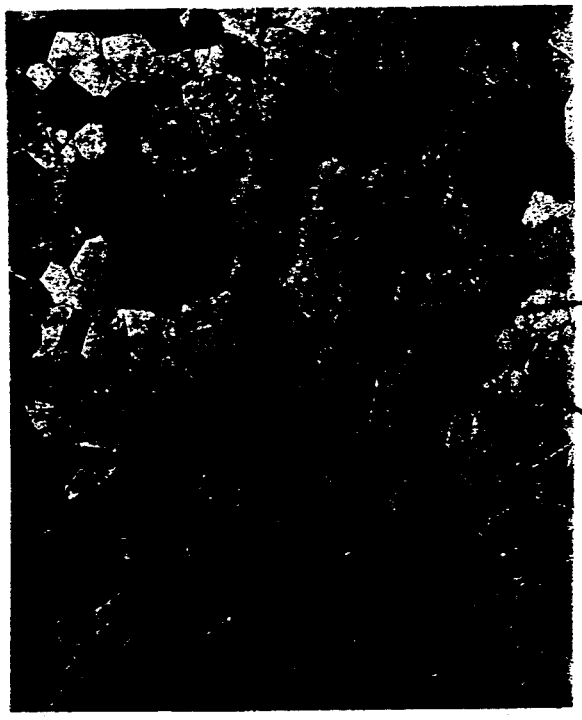
FIG. 4 is a photograph of a cross section of a metallic article formed by the spray casting process of the invention magnified 100 times.

FIG. 4 is a photograph of a cross section of the same copper alloy strip spray cast in accordance with the invention. As with the sample shown in FIG. 3, the image is through a microscope and magnified 100 times. The size of the grains 34 has been significantly reduced. The cross-sectional area of the grains has been reduced by a factor of approximately 9 times.

The size and the number of pores 36 have been greatly reduced significantly improving the ductility of the cast strip.

The inventors have reduced the porosity of the cast strip shown as in FIG. 4 by minimizing the entrapment of gas. In accordance with the invention, gas entrapment is reduced by changing the surface characteristics of the droplets. An effective amount of a reactive element is added to the molten alloy prior to atomization. An effective amount of the reactive element is that necessary to form a skin at least one atomic layer thick and which otherwise does not detrimentally affect the properties of the desired alloy. It has been found that with copper alloys, a decrease in electrical conductivity is usually an indication that the concentration of reactive metal is excessive. Typically, the desired concentration of the reactive element is from about 0.01 weight percent to about 1.0 weight percent. A most preferred concentration of reactive metal is from about 0.1 weight percent to about 0.5 weight percent.

The reactive element is selected to be soluble in the molten alloy. It should further not detrimentally affect the mechanical or electrical properties of the cast alloy.

The reactive element is further selected to react with the atomizing atmosphere. It will be apparent to one skilled in the art, that the process of the invention comprises an essentially three component system. The desired alloy, the reactive element and the atomizing atmosphere all interact. The composition of the components are selected so that the atomizing atmosphere and the reactive metal do not react with the selected alloy.

However, the reactive element and the atmosphere should readily react.

In a preferred embodiment of the invention, the molten alloy is a copper based alloy. A preferred atomizing atmosphere is nitrogen. The reactive element is selected to be an element which readily forms nitrides. Preferably, the reactive element is selected from the group consisting of aluminum, silicon, titanium, chromium and zirconium. Mixtures of reactive elements may be employed. A most preferred reactive element is aluminum because aluminum forms a very stable nitride. Aluminum readily dissolves in a copper based solution and disperses well.

Referring back to FIG. 4, the fine grained non-porous structure was formed by dissolving by weight aluminum in the copper alloy prior to spray casting.

The reactive element combines with the atmosphere and is believed to form a high surface tension film around the droplets. In the alloy illustrated in FIG. 4, the surface of the droplets which formed the strip was found to have a higher aluminum content than the bulk material. In addition, the reactive element acts as a getter reducing the formation of copper oxides and further improving the overall quality of the spray cast strip.

It is believed that the nitride and possibly a small quantity of oxide surface film reduce the porosity of the cast metal strip. The oxide originates from the combination of the reactive element with any residual oxygen in the spray chamber. When the molten stream is impinged by the atomizing gas, a plurality of randomly shaped droplets are formed. In the case of conventional spray casting, the droplets have a relatively low surface tension and retain the random configurations. Frequently the droplets contain folds and extensions. Upon collision with other droplets, the folds collapse upon themselves forming a pocket containing trapped gas. When the droplets strike the collector surface and solidify, the entrapped gas forms a pore.

In one method of the invention, the reactive metal forms a nitride skin on the surface of the droplets. The skin has a significantly higher melting point than the alloy droplet. For example, in the copper alloy example detailed above, the alloy melts at a temperature of about 1080° C. while $Al_2O_3$ solidifies at about 2015° C. and AlN solidifies at about 2235° C. The nitride skin solidifies exerting a compressive stress on the molten droplet. There are no other external forces shaping the droplet. The tendency of a liquid being subjected to a uniform compressive stress is to form a sphere. The droplets form spheres, of different sizes, but all having essentially the same shape. Since the folds and extensions are eliminated, collisions between droplets do not lead to gas entrapment and the amount of gas entrapment is drastically reduced.

As discussed hereinabove, the surface skin solidifies to form a strong, not readily pierced barrier layer. Even if collisions between droplets deform the droplets, the droplets will not collapse. Gas entrapment in the droplets is further reduced.

The alloys produced by this method have improved properties over conventional spray cast alloys. The density is increased leading to improved ductility and higher electrical conductivity. The grain size is reduced which is also a desired property.

The method also produces alloys having improved properties as compared to alloys produced by conventional casting techniques such as direct chill casting. The properties of the spray cast alloys are superior to conventionally cast alloys because there is less segregation and hot rolling to form strip is not required. The method of the invention is of limited value in the production of direct chill cast alloys since the reduced surface area of a conventionally cast ingot provides a limited surface area as combined to the bulk ingot.

While the invention has been described in terms of a specific copper alloy, the process is particularly suited for high performance copper alloys requiring high electrical conductivity (above about 50% IACS) and good ductility. An illustrative and by no means complete list of such alloys are copper alloy C151 (99.9% Cu, 0.1% Zr), copper alloy 194 (97.5% Cu, 2.35% Fe, 0.03% P and 0.12% Zn), copper alloy 195 (97% Cu, 1.5% Fe, 0.1% P, 0.8% Co and 0.6% Sn) and copper alloy 197 (99% Cu, 0.6% Fe, 0.2% P and 0.05% Mg).

Other copper based alloys which experience porosity during spray casting are also embodied within the process of the invention. For example, the phosphor bronzes, such as copper alloy C510 (94.9% by weight copper, 5% by weight tin, 0.1% by weight phosphorous nominal composition), are also significantly improved by the process of the invention.

While the invention has been particularly described in terms of the spray casting of copper based alloys, the process is readily adaptable to other alloy systems. Any alloy combination embraced by the parameters discussed hereinabove, namely, an atomizing gas which reacts with a reactive element but does not react with the desired alloy and a reactive element which does not detrimentally affect the desired alloy, may be improved by the process of the invention.

The patents and publication set forth in the application are intended to be incorporated by reference.

It is apparent that there has been provided in accordance with this invention a method for the manufacture of spray cast alloys having improved ductility and high density which fully satisfy the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A spray cast metal alloy having substantially reduced porosity formed by atomization with a gas which is generally nonreactive with copper and copper alloys, consisting essentially of:

a predominantly copper matrix; and a second phase dispersed throughout said matrix, said second phase consisting essentially of an additive combined with said gas.

2. The spray cast alloy of claim 1 wherein said atomizing gas is nitrogen and said second phase is a finely dispersed nitride.

3. The spray cast alloy of claim 2 wherein said additive is selected from the group consisting of aluminum, silicon, titanium, chromium or mixtures thereof.

4. A spray cast metal alloy having substantially reduced porosity consisting essentially of:

a predominantly copper matrix; and a second phase finely dispersed throughout said matrix, said second phase consisting essentially of the nitride of an additive selected from the group consisting of aluminum, silicon, titanium and chromium or mixtures thereof wherein the concentration of said additive is from about 0.01 weight percent to about 1.0 weight percent.

5. The spray cast alloy of claim 4 wherein the concentration of said additive is from about 0.1 weight percent to about 0.5 weight percent.

6. The spray cast alloy of claim 4 wherein said additive is aluminum.

7. The spray cast alloy of claim 4 wherein said predominantly copper matrix has an electrical conductivity above about 50% IACS and said second phase dispersion is selected from the group consisting of aluminum nitride, silicon nitride, titanium nitride, chromium nitride and mixtures thereof.

8. The spray cast alloy of claim 7 wherein said predominantly copper matrix has a composition 97.5% by weight copper, 2.35% by weight iron, 0.03% by weight phosphorus and 0.12% by weight zinc.

9. The spray cast alloy of claim 4 wherein said predominantly copper matrix is a phosphor bronze and said second phase dispersion is selected from the group consisting of aluminum nitride, silicon nitride, titanium nitride, chromium nitride and mixtures thereof.

10. The spray cast alloy of claim 9 wherein said phosphor bronze has the composition 94.9% by weight copper, 5% by weight tin and 0.1% by weight phosphorous.

* * * * *